US005169501A

United States Patent [19]

Meinecke

[11] Patent Number: 5,169,501

[45] Date of Patent: Dec. 8, 1992

[54] ARRANGEMENT FOR TRANSFERRING A WEB FROM THE PRESS SECTION TO THE DRYER SECTION OF A PAPER MACHINE

[75] Inventor: Albrecht Meinecke, Heidenheim, Fed. Rep. of Germany

[73] Assignee: J.M. Voith GmbH, Heidenheim, Fed. Rep. of Germany

[21] Appl. No.: 768,276

[22] PCT Filed: Jan. 15, 1991

[86] PCT No.: PCT/EP91/00049

§ 371 Date: Oct. 2, 1991

§ 102(e) Date: Oct. 2, 1991

[87] PCT Pub. No.: WO91/12370

PCT Pub. Date: Aug. 22, 1991

[30] Foreign Application Priority Data

Feb. 13, 1990 [DE] Fed. Rep. of Germany ..... 4004331

[51] Int. Cl.[5] ..... D21F 3/04; D21F 5/04

[52] U.S. Cl. ..... 162/359.1; 162/290; 34/116; 34/117

[58] Field of Search ..... 162/358, 359, 360.1, 162/290, 375; 34/116, 117, 123

[56] References Cited

U.S. PATENT DOCUMENTS

| | | | |
|---|---|---|---|
| 1,868,617 | 7/1932 | Tompkins | 162/375 |
| 3,250,019 | 5/1966 | Beachler | 162/359 |
| 3,981,084 | 9/1976 | Sobota | 162/359 |
| 4,000,035 | 12/1976 | Scheil et al. | 162/290 |
| 4,219,383 | 8/1980 | Valkama | 162/360.1 |
| 4,483,745 | 11/1984 | Wicks et al. | 162/358 |
| 4,561,939 | 12/1985 | Justus | 162/360.1 |
| 4,648,942 | 3/1987 | Wanke | 162/286 |

FOREIGN PATENT DOCUMENTS

| | | | |
|---|---|---|---|
| 346659 | 12/1989 | European Pat. Off. . | |
| 3600246 | 7/1986 | Fed. Rep. of Germany | 162/358 |

*Primary Examiner*—Karen M. Hastings
*Attorney, Agent, or Firm*—Baker & Daniels

[57] ABSTRACT

Arrangement for the transfer of a paper web from the press section 10 to the dryer section 20 of a paper machine, where a water-absorbent felt belt 11 of the last press 13, 14 has at the same time the function of a transfer felt 11; i.e., the transfer felt 11 transports the paper web 9 from the press section 10 to the dryer section 20. There, the transfer felt serves to force the paper web onto at least the first drying cylinder 21. This drying cylinder and additional drying cylinders 22 lie therefore outside the continuous loop of the transfer felt 11.

17 Claims, 3 Drawing Sheets

ARRANGEMENT FOR TRANSFERRING A WEB FROM THE PRESS SECTION TO THE DRYER SECTION OF A PAPER MACHINE

The invention concerns an arrangement for transferring a fiber material web, preferably a paper web (hereafter briefly referred to as "web"), from the press section to the dryer section of a paper machine. Concerned is thus an arrangement where a continuous belt passing through the last press gap of the press section and fashioned as a water-absorbent felt belt serves a dual function: The felt belt absorbs in the usual way at least part of the water pressed out of the web in the press gap and removes it. Additionally, this felt belt carries the web from the press section to the dryer section, where it passes together with the web at least over the first drying cylinder of the dryer section. Therefore, this felt belt will hereafter be called "transfer felt".

An arrangement of that type is known from the European patent document 0346659. In detail, it has the following features: The last press of the press section has only a single felt belt, namely a bottom belt which at the same time performs the function of a transfer felt. Thus, the web to be dewatered makes direct contact with the upper roll of the last press. Therefore, this upper roll has a smooth and generally hard shell surface, for instance fashioned from granite or artificial stone. It is generally known that with such arrangement the web adheres behind the press gap for a distance to the upper roll and must be pulled off under application of a certain tensile stress. In the process, the web runs for at least a short distance freely, i.e., without backing by the transfer felt. Besides, it is inevitable that the web, which here is still relatively moist and possesses thus only a low strength, suffers a certain elongation. This elongation is undesirable because it has a negative effect on the quality properties of the finished web; for instance, an undesirable cross contraction of the web results thereof. Even more aggravating, the mentioned elongation takes place irregularly across the web width, because the web edges are mostly more heavily stretched than the middle region of the web. This creates disuniform quality properties of the finished web, measured across the width of the web.

Another characteristic of the above proposal consists in arranging the first drying cylinder of the dryer section within the loop of the transfer felt. Thus, the web will not make direct contact with this first drying cylinder. Resulting thereof—especially at high operating speeds—is the risk that the paper web, due to centrifugal force, will lift off the transfer felt at the first drying cylinder.

Known from the U.S. Pat. No. 4,648,942 is an arrangement where the last press has the following characteristics: The web passes there between two felt belts through the press gap and from there to a separating device arranged in the bottom felt; the web separates there from the top felt and continues on with the bottom felt until it is transferred to the dryer section by means of the first drying wire of the dryer section and by means of a pickup suction roll. In the last press, the bottom roll is fashioned as a long-gap press roll; that is, this roll has a flexible revolving (hose or web type) and liquidtight pres element which by means of a press shoe can be pressed onto the top roll. A disadvantage of this arrangement is constituted in that the web very early on, i.e., as long as it is till relatively moist and soft, makes contact with the relatively hard and coarse drying wire. This entails the risk that the drying wire will leave permanent impressions behind in the paper web. Such impressions may be acceptable in the case of coarse paper grades, for instance such used for wrapping purposes, but not for printing and writing papers. Besides the adherence of the paper web to the relatively coarse surface is not always guaranteed, especially at high speeds.

The problem underlying the invention is t provide an arrangement for transferring a web from the press to the drying section of a paper machine that meets all of the following requirements;

1. An elongation of the web is to be avoided safely; i.e., the web must at no point travel freely (i.e., without backing by an accompanying belt). This applies to the press section, to the region between the press and the drying section and at least to the beginning area of the dryer section. Thus, the web must in the press section not make direct contact with a smooth and hard roll shell surface, from which it would have to be pulled off under application of a certain tensile stress.
2. The web must make contact with a drying wire as late as possible in order to preclude the risk of permanent impressions.
3. The arrangement should be suited particularly for the production of fine paper grades (for instance printing and/or writing papers), among them also relatively thin papers, at extremely high speeds (in the order of 2000 m/min or higher).

This problem is solved through the inventive features of the present invention.

What's essential on the invention is constituted by the combination of features which so far have been known only individually, namely carrying the web through the last press of the press section between two belts (of which the "first belt" also has the function of the transfer felt running from the press section to the drying section, same as before) and separating the web from the "second belt" by means of a separating device operating in a way such that a free web train will be avoided. Achieved thereby are two effects simultaneously: For one, any elongation of the paper web within the pres section and during the transfer to the dryer section is avoided; for another, the transfer felt is heated as it passes at least across the first drying cylinder of the dryer section, so that it will return to the last press at a temperature higher than before. This increases the dewatering capacity of the last press; for the heated felt now has a lower flow resistance to the water to be absorbed from the paper web.

The cited advantage, namely elimination of elongation of the paper web and increased dewatering capacity of the last press, now interact in such a way that in the production of the aforementioned fine paper grades (among them specifically thin paper grades) an above-average increase of the operating speed becomes possible as compared to before, namely to values around 2000 m/min or above. Moreover, with the transfer felt primarily working as a wet felt and thus required to have a relatively fine structure, the paper web clings in the transfer sections better to the felt, particularly at the contemplated high speeds of operation.

Set forth in one embodiment of the present invention is an important continuing idea of the invention. According to it, the transfer felt—in addition to the functions already cited, namely water absorption in the last press gap and transfer of the web to the dryer section—performs a third function in that it presses the web at least onto the first drying cylinder of the dryer section. That is, the arrangement is such that the web will always make direct contact with that drying cylinder(s) over which the transfer felt passes. This assures that the drying of the web in the dryer section commences swiftly from the outset. Besides, the necessity of an additional felt or wire belt is avoided on the said drying cylinder(s), in order to keep the web in contact with the transfer felt.

Adding to this is the further advantage that the paper web will in the initial region of the dryer section (i.e., at least on the first drying cylinder) be pressed onto the drying cylinder(s) by the transfer felt. Considering that the transfer felt has a fine structure, as mentioned before, the risk is avoided in the initial area of the dryer section that permanent impressions will be caused in the paper web, such as can be caused by a much coarser drying wire. In other words: The invention much more so than heretofore makes it possible to produce fine paper grades with the desired high quality properties.

The separating device required behind the last press gap may be given a rather different design: A suction box or suction roll may be provided in customary fashion. Or, a first suction guide roll of the dryer section is used as separating device. The arrangement of such a suction guide roll ahead of the first drying cylinder is frequently desirable in order to obtain a maximally large wrap angle on the first drying cylinder.

To further increase the dewatering capacity of the last press, it will preferably be fashioned as a long-gap press; i.e., one of the two rolls has —instead of a regular, for instance metallic roll shell—a flexible revolving (hose or belt type) press element which by means of a backing device (preferably press shoe) can be pressed onto the other roll.

The transfer felt may in the last press assume either the function of the bottom felt or the function of the top felt. Both variants will be more fully described farther down. The "second continuous belt" required according to the present invention—similar to the transfer felt—may either be fashioned as a water-absorbent felt belt; or it is designed as an elastic press belt with a relatively low water absorbability. Aside from this it is possible that the second belt directly forms the flexible (hose type or belt type) press element of a long-gap press. In this case, only a single water-absorbent felt belt (namely the transfer felt) is now provided in the last press.

Still other measures will suitably be applied that serve to further increase the dewatering capacity of the last press, namely in that the remoistening of the web behind the press gap is maximally reduced. For that purpose the provision may be that the transfer felt may be run, behind the press gap, for a distance without the web across an auxiliary guide roll and from it back to the separating device. In that case, the web runs behind the press gap at first only with the second belt and then changes over to the transfer felt, at the separating device fashioned as a pickup suction roll.

In case the last press features a long-gap press with press shoe, the press shoe according to DE-OS 38 15 278 may be so fashioned that it assumes at the same time the function of the separating device, where the remoistening of the web is reduced as well.

BRIEF DESCRIPTION OF THE DRAWINGS

Various embodiments of the invention will be described hereafter with the aid of the drawings.

DETAILED DESCRIPTION

Figure 1:
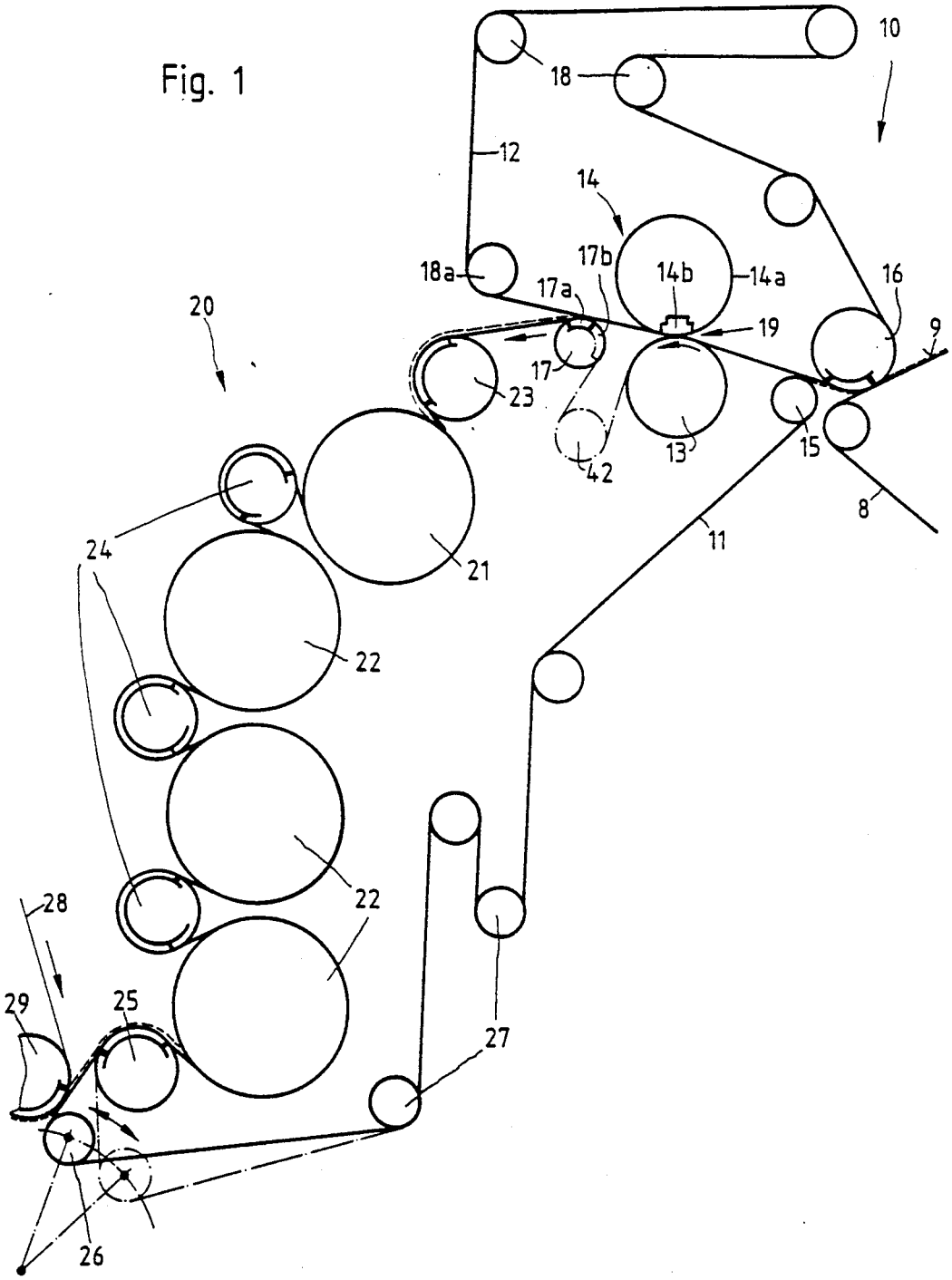
FIG. 1 shows schematically the last press and the first dryer section of a paper machine.

FIG. 1 illustrates a section of a paper machine with part of the press section 10 and the beginning area of a dryer section 20. Evident in FIG. 1, to begin with, is a dual felt press with an overhead long-gap press roll 14 and a lower backing roll 13. Schematically illustrated of the long-gap press roll 14 are a flexible revolving hose type press shell **14*a* and a press shoe 14*b* with which the press shell can be forced onto the backing roll. The usual stationary support body in which the press shoe 14*b* slides in radial direction and all other details have been omitted. The extended press gap formed by the press shell 14*a* and the backing roll 13 is marked 19. It is passed by a bottom felt 11, a top felt 12 and, in between, the paper web 9 to be dewatered (and subsequently dried). The paper web 9 is picked up fro ma preceding felt belt 8 by means of a pickup suction roll 16 situated in the top felt 12**.

The two felt belts 11 and 12, as usual, are normally fashioned as water-absorbent wet felts. As an alternative, a flexible press belt may be provided in lieu of the top felt 12, the water absorbability of which flexible press belt is lower than that of the bottom felt 11. The bottom felt 11 serves at the same time as transfer felt; that is, it transfers the paper web 9 from the press section 10 to the dryer section 20. Essential is that the transfer felt 11 serves at the same time to force the paper web 9 onto at least the first drying cylinder 21, preferably on a group of for instance four drying cylinders 21 and 22. Therefore, all of these drying cylinders 21, 22 are situated outside the continuous loop of the transfer felt 11.

Figure 4:
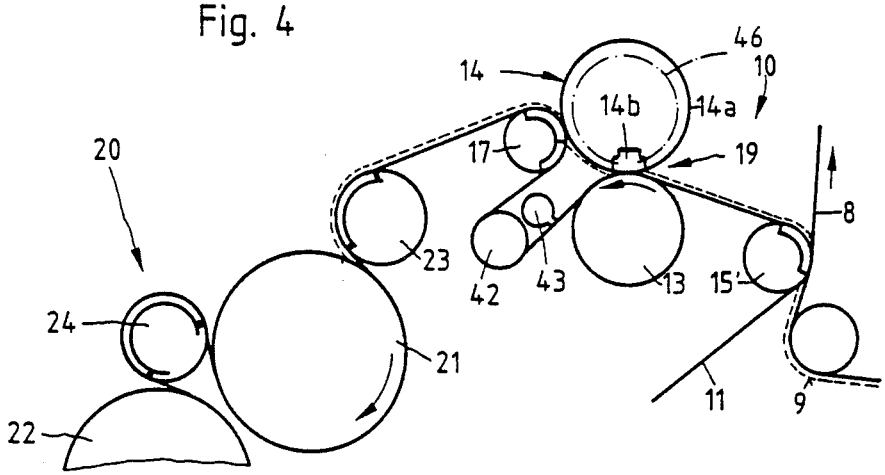

Behind the press gap 19, both felt belts 11 and 12 may at first jointly run (together with the paper web located in between) to a separating device 17. According to FIG. 1, this device is located within the loop of the transfer felt 1 and is fashioned as a suction roll with a pickup suction zone **17*a*, so that from here on the paper web 9 runs together with the transfer felt 11. An alternative is illustrated in FIG. 1 by broken lines: The transfer felt 11 is rerouted behind the press gap 19, without the web 9, across an auxiliary guide roll 42 and returns then to the separating device 17. In the area of this rerouting, the transfer felt 11 is conditioned, for instance in that the separating device 17 fashioned as a suction roll features a conditioning suction zone 17*b*. As an alternative or additionally, the auxiliary guide roll 42 may be fashioned as a suction roll or as a blowing roll; or a tubular sucker is provided (FIG. 4, reference 43**).

Before the first drying cylinder 21, the transfer felt 1 runs together with the paper web 9 over a guide roll 23. Additionally, a guide roll 24, 25 is provided behind each of the drying cylinders 21, 22. All of these guide rolls are located within the loop of the transfer felt 11, so that the paper web 9 is located, in the area of the guide rolls, on the outside of the transfer felt and, therefore, is exposed to a certain centrifugal force. To counteract the centrifugal force, the guide rolls 23, 24, 25 are customarily fashioned as suction rolls. From the last suction guide roll 25 the transfer felt 11 runs over an adjustable guide roll 26 and over further guide rolls 27 back to the guide roll 15 of the press section 10. Between the guide rolls 25 and 26, the paper web 9 is picked up from the transfer felt 11 by means of another felt belt or drying wire 28 and by means of a pickup suction roll 29 and is passed to a subsequent, not illustrated dryer station.

In FIG. 1, the drying cylinders 21 and 22 for an essentially vertical cylinder row. Instead, the drying cylinders could also be arranged though in an essentially horizontal row.

Figure 2:
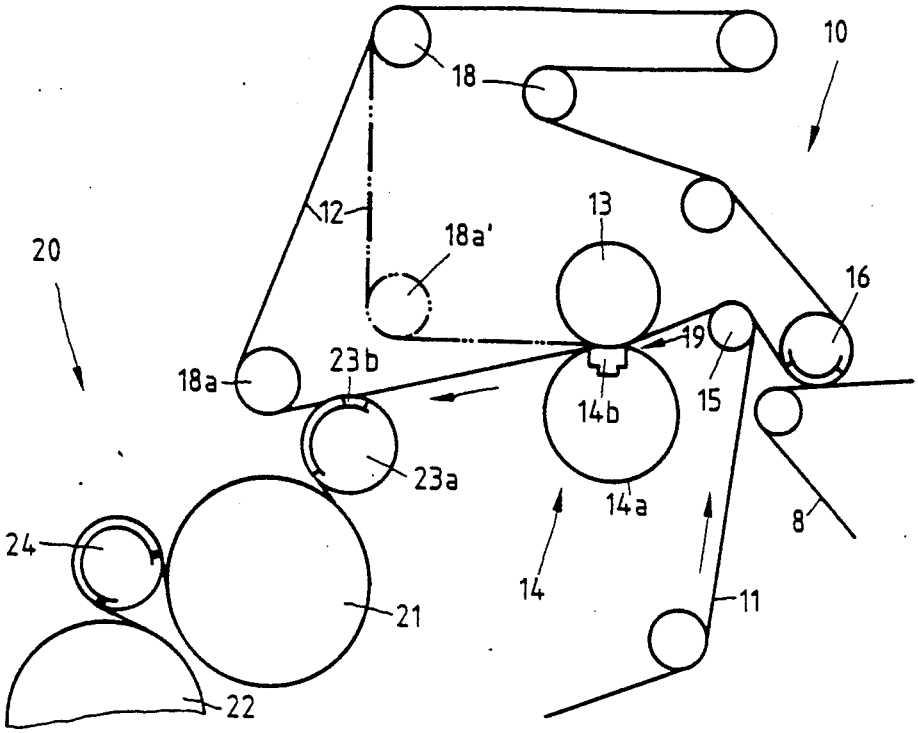
FIGS. 2 and 4 through 6 show modifications of the arrangement relative to FIG. 1.

In FIG. 2, in variation from FIG. 1, the long-gap pres roll 14 is arranged below the backing roll 13. Another difference to FIG. 1 is given in that for the separation of the top felt 12 from the paper web 9 and from the transfer felt 11 there is no specific separating device provided (as in FIG. 1, reference 17). Illustrated are two other variants. According to the first variant illustrated by solid lines, both felt belts 11 and 12 run together, jointly with the paper web in between, up to the first suction guide roll 23*a*. The latter, if required, may have a presuction zone 23*b* which is located before the point where the two felts run onto the suction guide roll. The top felt continues then on over a guide roll 18*a* and the other guide rolls 18 back to the pickup suction roll 16.

Figure 3:
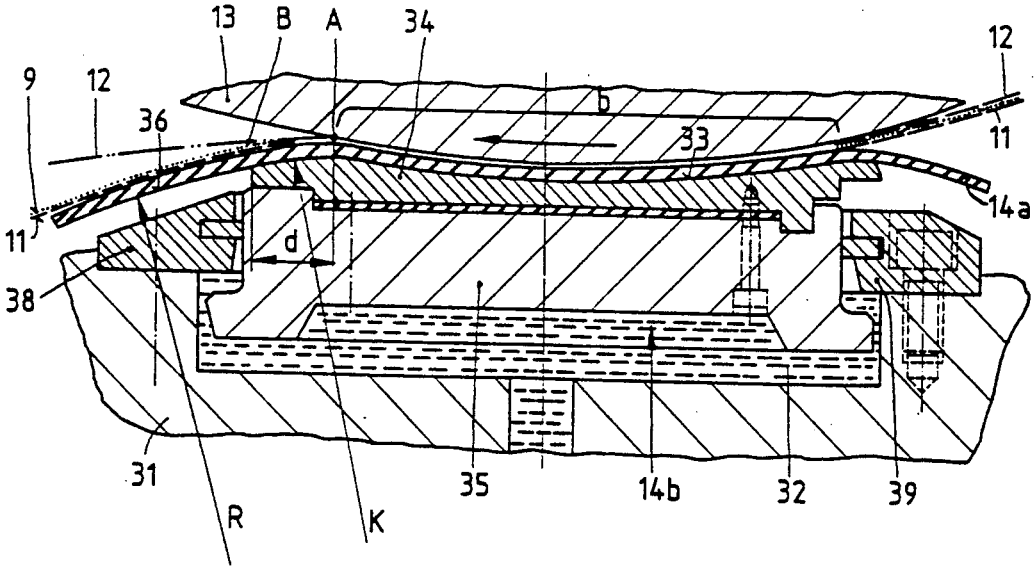
FIG. 3 shows a cross section of the press shoe of a long-gap press roll (scaled-up detail from FIG. 2).

According to a second variant, illustrated by double-dot-dash lines, the two felt belts 11 and 12 separate shortly behind the outlet from the extended press gap 19. This is desirable in order to avoid behind the press gap 19 the remoistening of the paper web from the top felt 12 as much as possible. To accomplish this, the following provision is made on the press shoe 14*b* according to FIG. 3 (known as such from the German patent disclosure 38 08 293): The press shoe is divided in an upper part 34 and a piston acting as bottom part 35. The latter is arranged in a pressure chamber 32, which is a recess in the stationary support body 31. To guide the press shoe and seal the pressure chamber 32, sealing strips and pertaining sealing strip carriers 38 and 39 are used. The center part of the gliding surface 33 of the press shoe top part 34 forms the contact surface with a concave contour and a width b. In the running direction, behind the contact surface, the pres shoe top part 34 has a guide surface 36 with a convex curvature. Its radius of curvature K may be approximately equal to the radius R of the orbit of the press shell 14*a*. From the leaving end A of the press gap, the two felt belts 11 and 12 (with the paper web 9 in between) and the press shell 14*a* proceed first across the guide surface 36. The upper felt 12 lists off the paper web 9 only at the point B, i.e., shortly before the leaving end of the press shoe top part 34, and continues from here to the guide roll 18*a*' (FIG. 2). Between points A and B, air is able to penetrate the upper felt 12, so that the paper web 9 will at the point B safely separate from the upper felt and follow along with the bottom felt (transfer felt 11) (toward the suction guide roll 23*a*, FIG. 2). The width of the guide surface 36 (in the direction of web travel) is signified d.

FIG. 4 differs from FIG. 1 in that no top felt is present in the press. In this case, thus, the hose type press shell 14*a* of the long-gap press roll 14 assumes the function of the second belt (provided according to FIG. 1). The nonrotating (radially movable) press shoe 14*b* can be replaced by a rotatable roll body 46, which is indicated by broken line. The transfer felt 11 is reversed behind the press gap 19 without the web 9, namely past a tubular sucker 43 and across an auxiliary guide roll 42 and, finally, back to the separating device 17 fashioned as a suction roll. The latter is so arranged that the inflatable press shell 14*a* forms a small wrap zone on the suction roll 17. This assures a safe transfer of the web 9 from the press shell 14*a* to the transfer felt 11. Before the press gap 19 and within the loop of the transfer felt 11 there is a pickup suction roll 15' provided which assures that the web 9 will transfer from the preceding felt belt 8 to the transfer felt 11.

Figure 5:
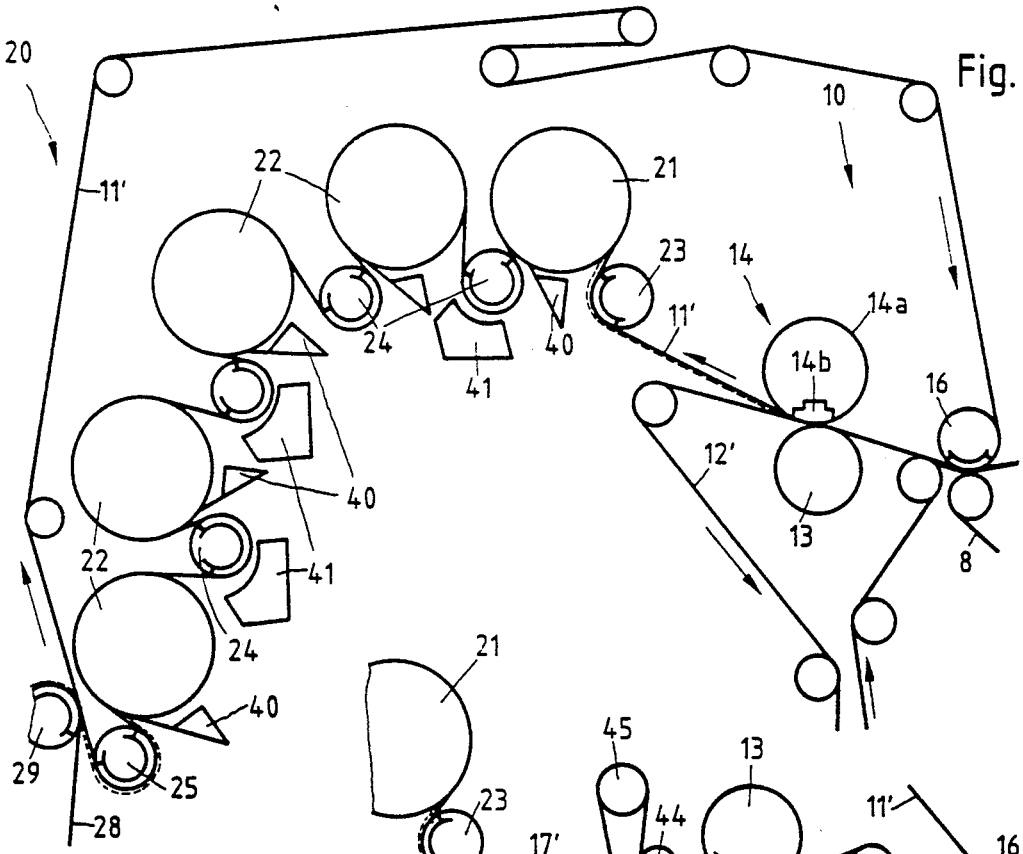

According to FIGS. 1 through 4, the bottom felt 11 of the last press 13, 14 has the function of the transfer felt. In FIG. 5, contrarily, the arrangement is such that the top felt 11' has the function of the transfer felt, with the top roll fashioned as a long-gap press roll 14. The bottom felt is marked 12'. The press shoe 14*b*, in turn, may be fashioned according to FIG. 3, so that the two felt belts 11' and 12' will separate at the leaving end of the press shoe. The top felt 11' again carries the paper web 9 across a first suction guide roll 23 and thereafter alternately across drying cylinders 21, 22 and further suction guide rolls 24 and 25. Schematically illustrated are scrapers 40 bearing on the free part of the cylinder surfaces. Scrapers of that type are present also in the design according to FIGS. 1, 2 and 4, but have been omitted in the drawing. In FIG. 5, hot air blow boxes 41 are additionally indicated which are the suction guide rolls 24 blow hot air at the paper web and which additionally can suck up exhaust air.

Any scrap occurring with the arrangement according to FIG. 5 (upon paper web break) can unimpededly drop down on the side of the cylinder row 21, 22 on the near side of the press section. Contrarily, in FIGS. 1, 2 and 4, any scrap must be removed downwardly, on the other side of the cylinder row 21, 22. This requires moving the adjustable guide roll 26 according to FIG. 1 into the position indicated by dash-dot lines, so that the scrap may drop down between the suction guide rolls 25 and 29.

Figure 6:
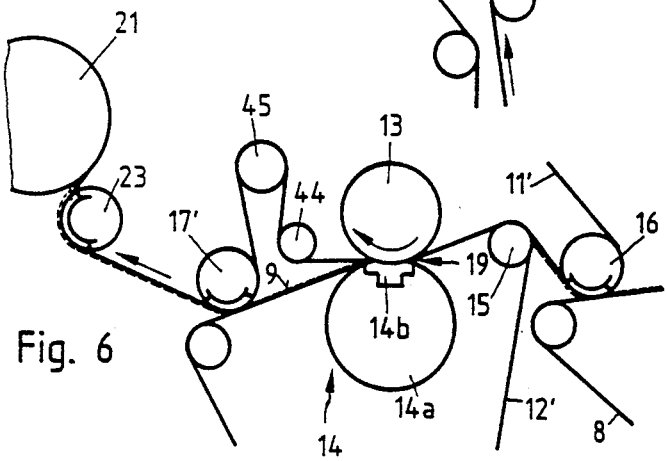

FIG. 6 differs from FIG. 5 only in that—similar to FIG. 2—the bottom roll is fashioned as a long-gap press roll 14. Behind the press gap, the transfer felt (top felt 11') is without the web 9 passed across two auxiliary guide rolls 44 and 45, to a separating device 17' fashioned as a pickup suction roll. The aforementioned felt conditioning devices are not illustrated in FIG. 6.

I claim:

1. An arrangement for the transfer of a web from the press section to the dryer section of a paper machine, said press section including a last press gap and said dryer section comprising a plurality of drying cylinders including a first drying cylinder, wherein said web passes through said last press gap in said press section and across said first drying cylinder in said dryer section, said arrangement comprising:

a first continuous belt, said first continuous belt forming a continuous loop and being arranged to pass together with said web through said last press gap and also across said plurality of drying cylinders, all of said drying cylinders being positioned outside said continuous loop formed by the first continuous belt;

a second continuous belt, said second continuous belt being arranged to pass through said last press gap so that said web is contained between said first and second continuous belts in said press gap; and a separating device for separating said second continuous belt from said web and said first belt, said separating device being positioned within the loop formed by said first continuous belt and arranged so that said first and second continuous belts and said web contained therebetween run across said device after said belts and web pass through said last press gap.

2. The arrangement of claim 1, wherein said first continuous belt comprises a water-absorbent felt belt, and wherein said web comprises a paper web.

3. The arrangement of claim 1, further including a guide roll positioned immediately preceding said first drying cylinder along said continuous loop, wherein said first continuous belt and said web run across said guide roll, said guide roll being positioned within said loop.

4. The arrangement of claim 3, wherein said guide roll is a suction guide roll.

5. The arrangement of claim 3, wherein said guide roll is positioned between said separating device and said first drying cylinder.

6. The arrangement of claim 1, wherein said separating device comprises a guide roll.

7. The arrangement of claim 6, wherein said guide roll is a suction guide roll.

8. The arrangement of claim 1, in which said last press gap is formed by a pair of generally vertically aligned press rolls, wherein said first continuous belt runs across the lowermost of said aligned rolls.

9. The arrangement of claim 1, in which said last press gap is formed by a pair of generally vertically aligned press rolls, wherein said first continuous belt runs across the uppermost of said aligned rolls.

10. The arrangement of claim 1, wherein said second continuous belt comprises a water-absorbent felt belt.

11. The arrangement of claim 1, wherein said second continuous belt comprises an elastic press belt, said second belt having a water absorbability less than the water absorbability of said first continuous belt.

12. The arrangement of claim 1, in which said second continuous belt comprises a flexible hose-type and fluid tight press shell, and wherein said arrangement further includes a support device for forcing said second belt on a backing roll in said press gap.

13. The arrangement of claim 12, wherein said support device comprises a press shoe.

14. The arrangement of claim 12, wherein said support device comprises a roll body.

15. The arrangement of claim 1, further including at least one auxiliary guide roll positioned between said press gap and said separating device, said auxiliary guide roll being arranged so that said first continuous belt runs along a path without said web across said guide roll and back to said separating device, said first continuous belt comprising a water absorbent felt, said separating device comprising a pick-up suction roll, said suction roll being positioned within said continuous loop and arranged whereby said suction roll touches said second belt so that said web may be separated therefrom; said arrangement further including a felt conditioning device positioned along said path.

16. The arrangement of claim 1, further including a long-gap press roll, said long-gap press roll including a flexible revolving press element, said press roll being positioned in said arrangement so that said press gap is formed as said press element is forced onto a backing roll, said press element being in contact with said first continuous belt; a press shoe for forcing said press element on a backing roll, said press shoe having, in the direction of web travel, a generally convex-curved guide surface across which passes said flexible press element; said second continuous belt being routed so that it runs together with said web and said first belt across a portion of said convex-curved surface while separating thereafter.

17. An arrangement for the transfer of a web from the press section to the dryer section of a paper machine, said press section including a last press gap and said dryer section comprising a plurality of drying cylinders including a first drying cylinder, wherein said web passes through said last press gap in said press section and across said first drying cylinder in said dryer section, said arrangement comprising:

a first continuous belt, said first continuous belt forming a continuous loop and being arranged to pass together with said web through said last press gap and also across at least said first drying cylinder, said drying cylinders being positioned outside said loop;

a second continuous belt, said second continuous belt being arranged to pass through said last press gap so that said web is contained between said first and second continuous belts in said press gap;

a separating device for separating said second continuous belt from said web and said first belt, said separating device being positioned within the loop formed by said first continuous belt and arranged so that said first and second continuous belts and said web contained therebetween run across said device after said belts and web pass through said last press gap; and at least one auxiliary guide roll positioned between the press gap and the separating device, said auxiliary guide roll being arranged so that said first continuous belt runs along a path without the web across the guide roll and back to the separating device, said first continuous belt comprising a water absorbent felt, said separating device comprising a pick-up suction roll, said suction roll being positioned within the continuous loop and arranged whereby said suction roll touches the second belt so that the web may be separated therefrom; said arrangement further including a felt conditioning device positioned along the path.

* * * * *